US009560901B2

(12) United States Patent
Wytenhove et al.

(10) Patent No.: US 9,560,901 B2
(45) Date of Patent: Feb. 7, 2017

(54) LUGGAGE COMPRISING A VACUUM DEVICE

(76) Inventors: Marguerite Wytenhove, Honesdale, PA (US); Jean-Charles Agniel, Thoard (FR); Riou Agniel, Thoard (FR)

( * ) Notice: Subject to any disclaimer, the term of this patent is extended or adjusted under 35 U.S.C. 154(b) by 399 days.

(21) Appl. No.: 13/817,492

(22) PCT Filed: Apr. 29, 2010

(86) PCT No.: PCT/IB2010/000973

§ 371 (c)(1),
(2), (4) Date: Mar. 26, 2013

(87) PCT Pub. No.: WO2011/135391

PCT Pub. Date: Nov. 3, 2011

(65) Prior Publication Data

US 2013/0180816 A1 Jul. 18, 2013

(51) Int. Cl.

| | |
|---|---|
| ***A45C 15/00*** | (2006.01) |
| ***A45C 5/00*** | (2006.01) |
| ***A45C 5/03*** | (2006.01) |
| ***A45C 5/14*** | (2006.01) |
| ***A45C 7/00*** | (2006.01) |
| ***A45C 13/02*** | (2006.01) |
| ***A45C 13/26*** | (2006.01) |
| ***A45C 13/28*** | (2006.01) |

(52) U.S. Cl.

CPC . *A45C 5/00* (2013.01); *A45C 5/03* (2013.01); *A45C 5/14* (2013.01); *A45C 7/0022* (2013.01); *A45C 13/02* (2013.01); *A45C 13/262* (2013.01); *A45C 13/28* (2013.01); *A45C 15/00* (2013.01); *A45C 2013/028* (2013.01)

(58) Field of Classification Search

CPC ..... A45C 5/00; A45C 5/03; A45C 5/14; A45C 7/0022; A45C 13/02; A45C 13/262; A45C 13/28; A45C 15/00; A45C 2013/028

USPC ..... 206/524.8; 220/231

See application file for complete search history.

(56) References Cited

U.S. PATENT DOCUMENTS

| | | | | |
|---|---|---|---|---|
| 3,000,418 | A * | 9/1961 | Bitting | 180/53.8 |
| 3,450,237 | A * | 6/1969 | Dyke | 190/103 |
| 5,080,206 | A * | 1/1992 | Tawil | 190/103 |
| 5,228,546 | A * | 7/1993 | Chang | A45C 5/02 190/103 |
| 5,397,000 | A * | 3/1995 | Holte et al. | 206/545 |
| 5,398,811 | A * | 3/1995 | Latella, Jr. | 206/524.8 |
| 5,485,921 | A * | 1/1996 | Tolendano | 206/545 |
| 5,806,575 | A * | 9/1998 | Tsay | 141/65 |
| 6,135,253 | A * | 10/2000 | Weissman et al. | 190/36 |
| 6,135,277 | A * | 10/2000 | Armstrong | 206/314 |
| 6,202,849 | B1 * | 3/2001 | Graham | 206/524.8 |
| 6,510,946 | B2 * | 1/2003 | Gutierrez et al. | 206/545 |
| 7,475,782 | B2 * | 1/2009 | Lombardi | 206/524.8 |
| 7,975,816 | B1 * | 7/2011 | Lin | A45C 7/0027 190/103 |

(Continued)

*Primary Examiner* — Tri Mai

(74) *Attorney, Agent, or Firm* — Brouillette and Partners; Robert Brouillette

(57) ABSTRACT

The present invention discloses a container comprising a pump to vacuum the air contained in the container. The pump is combined with the telescopic handle of the container. A check valve in communication with the interior chamber of the container is connected to the vacuum pump for withdrawing air from the container to decrease the volume occupied by the items contained in the container.

12 Claims, 6 Drawing Sheets

(56) References Cited

U.S. PATENT DOCUMENTS

| | | | | |
|---|---|---|---|---|
| 8,042,662 | B2 * | 10/2011 | Su | 190/115 |
| 2005/0081891 | A1 * | 4/2005 | Arjomand | 134/21 |
| 2005/0152801 | A1 * | 7/2005 | Chen | B65D 33/01 417/572 |
| 2008/0185250 | A1 * | 8/2008 | Martins | A45C 13/008 190/108 |
| 2009/0145939 | A1 * | 6/2009 | Robinson | 224/231 |
| 2011/0259693 | A1 * | 10/2011 | Nascarella | 190/18 A |

* cited by examiner

LUGGAGE COMPRISING A VACUUM DEVICE

CROSS-REFERENCE TO RELATED APPLICATIONS

There are no cross-related applications.

FIELD OF THE INVENTION

The present invention generally relates generally to the field of suitcases, luggage or carry-on bags for travel. More specifically the present invention relates to a luggage comprising a vacuum system for easy and effective packing of clothing materials and other items.

BACKGROUND OF THE INVENTION

Most of the items places in luggage such as clothes retain air between the fibers. The air comprised between the fibers and between the different items occupies a large amount of the volume of the luggage. There have been attempts to provide luggage having means to reduce the volume of the items contained in it. For example, in prior art, a user applies a force by hand to the clothes or other similar items in order to minimize their volume and then close the luggage over the items.

Some other solutions presented in prior art rely on separately storing clothing in pre-made vacuum bags that can compress the clothing or items when a vacuum is applied to them. These bags are separate from the luggage and have no formal shape or design purpose other than storing individual clothing item in a pre-compressed state for later storage in a luggage. Thus several such bags may be needed to effectively store clothing or the like for travel. Further they do not form a simple single integrated system for storing items of clothing, and are generally bought separately from the luggage. Furthermore, the user will probable don't have necessary equipment to compress again the articles of clothing when travelling back.

SUMMARY OF THE INVENTION

The aforesaid and other objectives of the present invention are realized by generally providing a piece of luggage comprising a vacuum device to contain compressible articles, the luggage comprising a plurality of walls comprising an internal chamber, wherein the internal chamber is airtight and wherein the internal chamber comprises an opening; sealing means to sealingly close the opening of the internal chamber; a telescopic handle integrated into at least one of the walls, the telescopic handle comprising at least one plunger having a first extremity and a second extremity; at least one body, wherein the plunger is comprised in the body; and a handle connected to the first extremity of the plunger; at least one manual vacuum pump, each of said manual vacuum pump comprising an air chamber, wherein the air chamber and the body are unitary; at least one check valve connected to the internal chamber and to the air chamber; and a piston comprised in the air chamber, wherein the piston is connected to the second extremity of the plunger, wherein the manual pump allows the removal of a substantial part of the air contained in the internal chamber.

The terms "baggage", "suitcase", "luggage" and "travel container" are considered equivalent for purposes of this application and are used interchangeably.

The luggage comprises an enclosed sealable compartment for vacuum sealing articles of travel such as clothing, makeup accessories, and other articles generally accompanying a traveler. The luggage is preferably constructed in the manner of a traveling bag or suitcase comprising of a top cover and a more rigidly constructed bottom receptacle; the bottom receptacle serves as storage space for the various articles of travel.

The luggage comprises a manual pump that is integrated within the suitcase to occupy a minimum of volume. The pump comprises a handle, a piston and a check valve connected to the interior of the luggage. The vacuum pump removes a substantial part of the air from the chamber, and from articles so as to reduce the volume occupied by said articles of travel to a minimum, thereby increasing the storage efficiency of the container.

The valve is preferably a check valve type which permits the passage of a gas or fluid in one direction, but not in the other. The valves connecting the sealed compartment to the pump are typically one-way valve as illustrated for example, but not limited to, in U.S. Pat. No. 5,127,804, U.S. Pat. No. 5,538,398, U.S. Pat. No. 4,120,614, U.S. Pat. No. 5,626,072 or U.S. Pat. No. 5,051,073.

In a further embodiment, the luggage comprises a double handle. There are two manual pumps, each one connected to one of the extremity of the handle, or plunger. This allows the removal of the air to be performed more rapidly thus resulting in less effort from the user to vacuum the content of the luggage.

In one embodiment of the present invention, the walls of the luggage are airtight and sealable by vacuum, so that the luggage minimizes the volume required to store the articles of travel, thus achieving a higher volume of available storage space for articles of travel stored therein.

In a preferred embodiment, the walls of the container are lined with a plastic film that serves to seal the chamber. The container cover also comprises a sealing plastic material, or cloth material lined with a sealing plastic film or liner. The storage chamber has built-in check valves that allow air to bleed in and out of the storage chamber as desired. When articles of travel are stored in the article compartment, or chamber, and the compartment cover is sealably attached to the container, the air comprised in the articles and the air in the unused spaces in the chamber can be evacuated to minimize the volume of the articles allowing more articles of travel to be stored in the container than would otherwise be possible.

In another embodiment of the invention, the outer shell of the luggage need not be air-tight, but the internal chamber has an airtight lining that form a sealed chamber for vacuum packing articles of travel.

When a user needs to access the articles, he can simply open the luggage and the chamber. In a further preferred embodiment, a bypass valve comprising a vacuum release valve is opened to allow air to go back into the chamber.

In a preferred embodiment, the luggage comprises an expandable section. This section allows the luggage to be reduced in volume after having been closed.

Sealing means for sealingly close the internal chamber are already known in the art, examples are shown in U.S. Pat. No. 2,615,224, U.S. Pat. No. 4,524,493, U.S. Pat. No. 4,780,937 or U.S. Pat. No. 4,765,038.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel luggage comprising a vacuum device will be described hereinafter. Although the invention is described in terms of specific illustrative embodiment(s), it is to be understood that the embodiment(s) described herein are by way of example only and that the scope of the invention is not intended to be limited thereby.

Figure 1A:
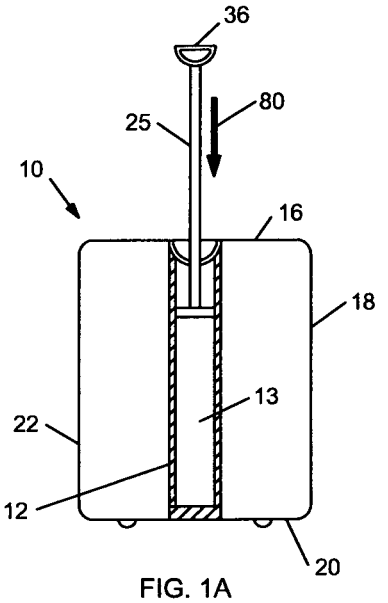
FIGS. 1A to 1G are schematic illustrations of the steps performed to vacuum the air contained in the luggage.
Figure 1B:
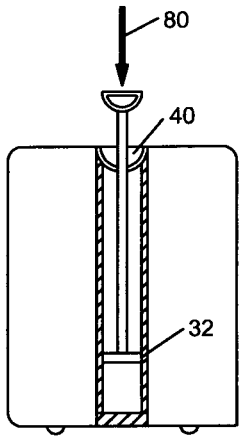
Figure 1C:
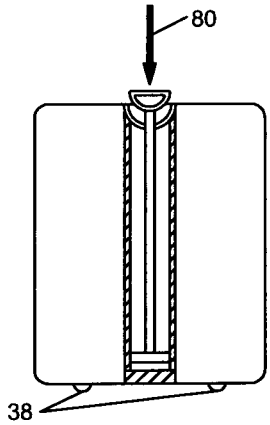
Figure 1D:
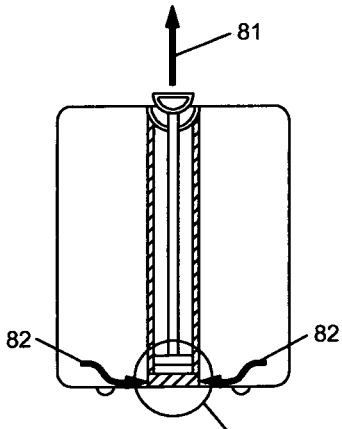
Figure 1E:
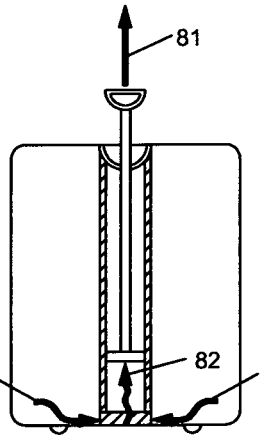
Figure 1F:
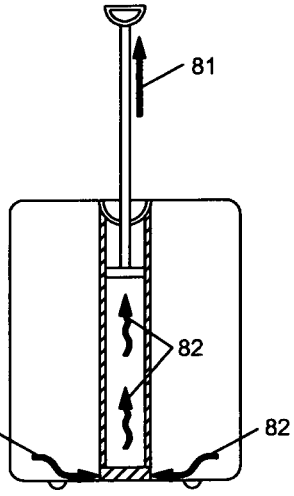
Figure 1G:
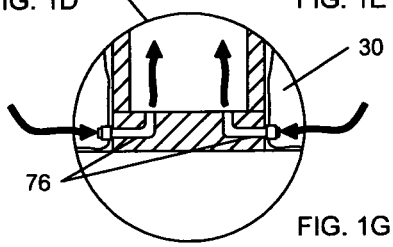

The luggage 10 is adapted to be hermetically sealed with the help of the hand held vacuum pump 12. The telescopic handle of the luggage comprises a handle 36 and a plunger 25 and this plunger 25 interacts with the piston 32 to activate the vacuum pump 12. As shown in FIG. 1, the luggage 10 comprises the vacuum pump 12 which is connected to a check valve 76 (schematically illustrated) that is in communication with the interior chamber 30 to enable the vacuum pump 12 to withdraw or suck air from the chamber 30. The vacuum pump also comprises an air chamber 13. To remove the air contained in the housing or chamber 30, a user pushes 80 and pulls 81 on the handle 36 as for a manual pump. To vacuum the air contained in the chamber 30, the user first hermetically closed the luggage 10 and then activates the vacuum pump 12 using the handle 36 as described previously. In FIGS. 1A to 1C, it is shown that by applying a force 80 to the handle 36, the plunger 25 and the piston 32 moves downwardly until the piston 32 is at its lowest position illustrated in FIG. 1C. The user then pulls 81 on the handle 36 as shown in FIGS. 1D to 1F. By doing so, the air contained in the chamber 30 is sucked out thereby reducing the volume of the articles contained in the chamber 30. The flow of the air is illustrated by the arrows 82. FIGS. 5A to 5G show another embodiment of the present invention having a double handle 536.

Figure 2B:
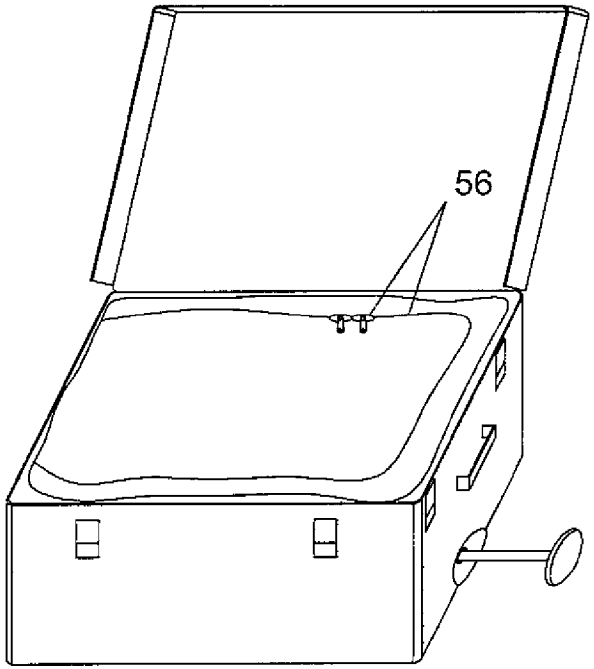
FIGS. 2A and 2B are perspective views of a first embodiment of the luggage of the present invention.
Figure 2A:
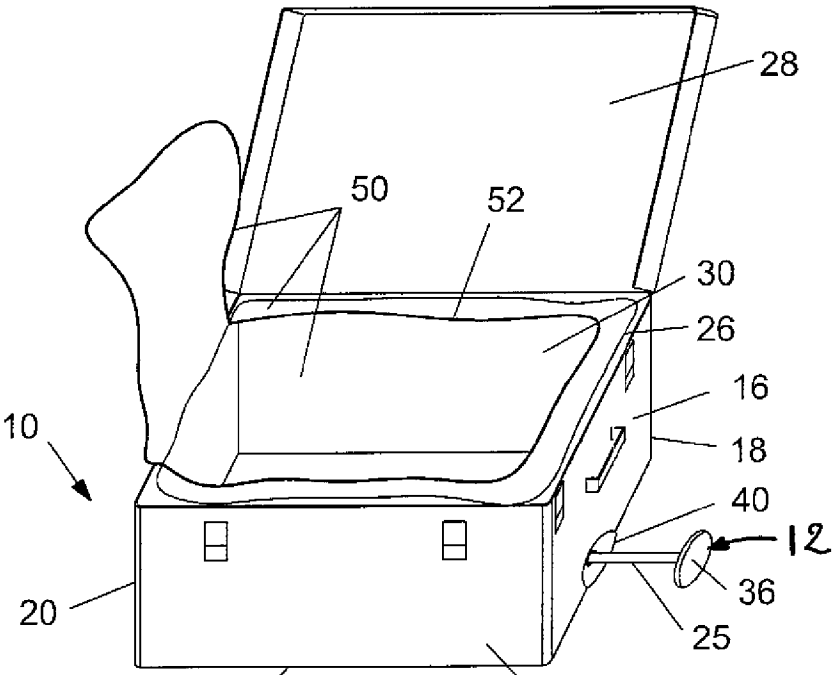

As shown in FIG. 2A, a preferred embodiment of the luggage 10 comprises a generally rectangular box or housing having four sides or sidewalls 16, 18, 20, and 22 which project vertically upwardly from a bottom wall 24 to form a top opening 26 and a closure member or cover 28 adapted to form a closed accessible interior chamber 30 for storing articles. The luggage comprises a hermetic or airtight lining 50 made from a polymer or from a polymeric fabric, for example. The lining 50 comprises an opening 52 through which the articles are disposed, the lining 50 is comprised in the internal chamber 30. The opening 52 can be hermetically closed using sealing means such as a hermetic slide fastener 56. It is to be noted that the overall volume of the lining 50 is preferably larger than the volume of the luggage 10.

In use, articles are disposed inside the chamber 30 and then the chamber 30 is closed using the hermetic slide fastener 56 shown in FIG. 2B. Then, the user activates the manual pump 12 using the handle 36 to remove the air contained in the chamber 30. The volume of the articles then decrease as the air contained in the articles and between them is sucked out of the chamber 30 through the check valves. It is to be understood that to be able to close the luggage 10, the reduced volume of the articles should be almost equal or smaller than the volume of the luggage 10 itself. The luggage 10 can then be closed using a slide fastener 56 and/or with fasteners or other means as already known in the art for luggage.

Figure 3B:
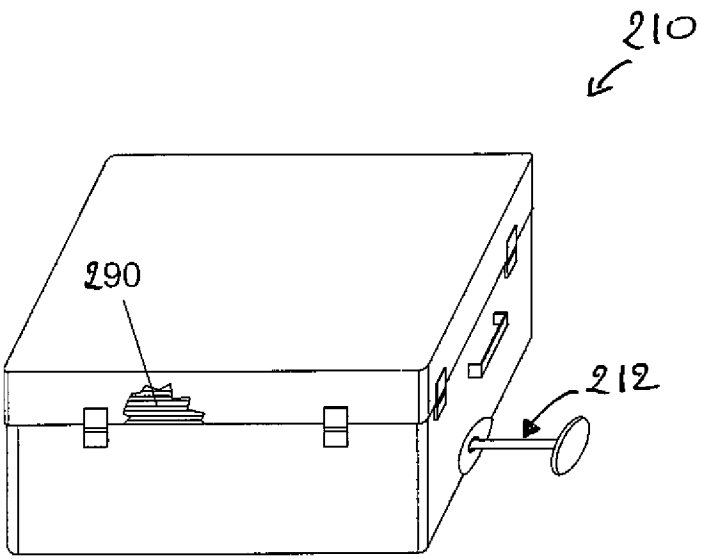
FIGS. 3A, 3B and 3C are perspective views of a second embodiment of the luggage of the present invention.
Figure 3A:
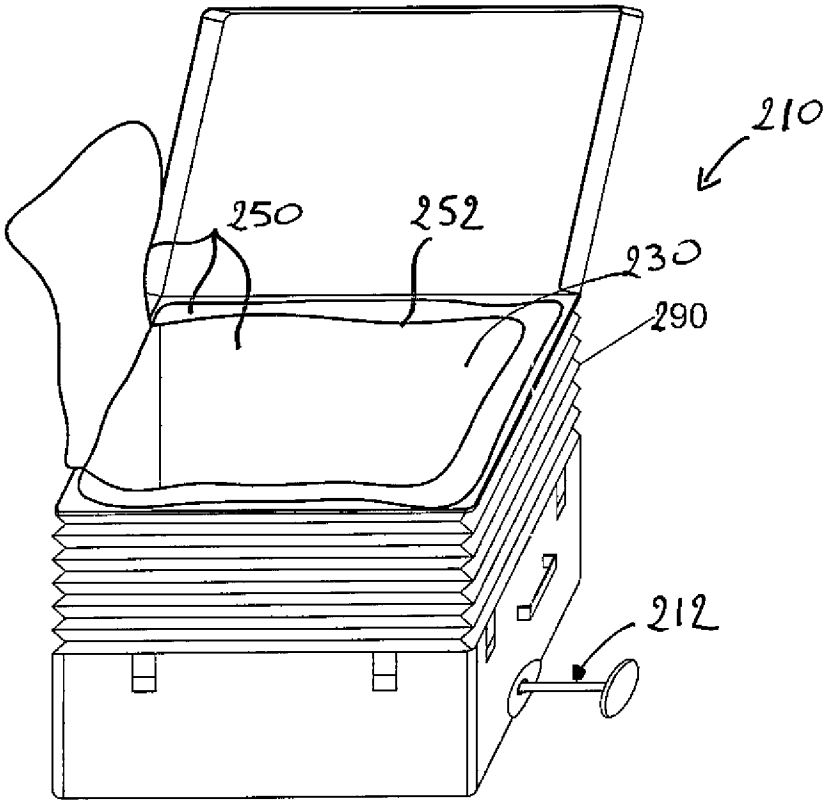
Figure 3C:
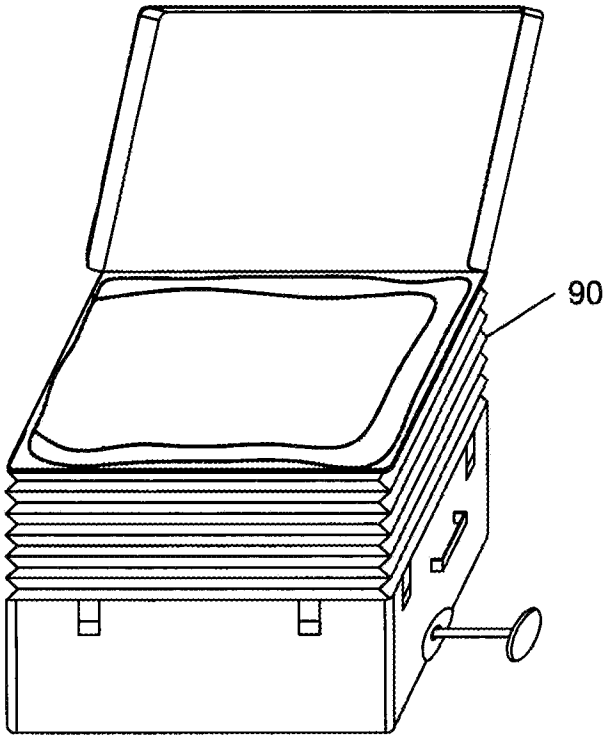

FIGS. 3A and 3B show another embodiment of the present invention. The luggage 210 comprises a hermetic lining 250 having an opening 252 which is hermetically closed using slide fastener 56 as shown previously in FIGS. 2A and 2B. The luggage 210 comprises an expandable section 290. It is to be noted that the lining 250 may be attached to the walls of the luggage 210 and to the expandable section 290 or not. In use, when the articles have been disposed in the chamber 230, this chamber 230 is then hermetically sealed using sealing means. The user then activates the manual pump 212 as described previously. In a first case, when the lining 250 is attached to the walls of the luggage 210, when the air is removed from the chamber 230, the expandable section 290 will compress on itself by itself. In a second case, when the lining 250 is not attached to the walls of the luggage 210, only the chamber 230 will reduce of size. The user will compress the expandable section 290 himself prior to close the luggage using known means in the art.

Figure 4B:
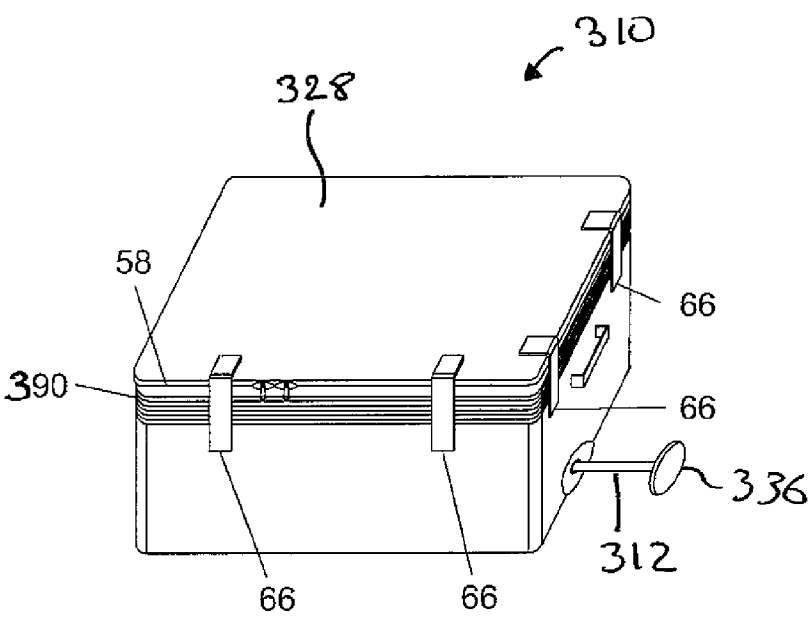
FIGS. 4A and 4B are perspective views of a third embodiment of the luggage of the present invention.
Figure 4A:
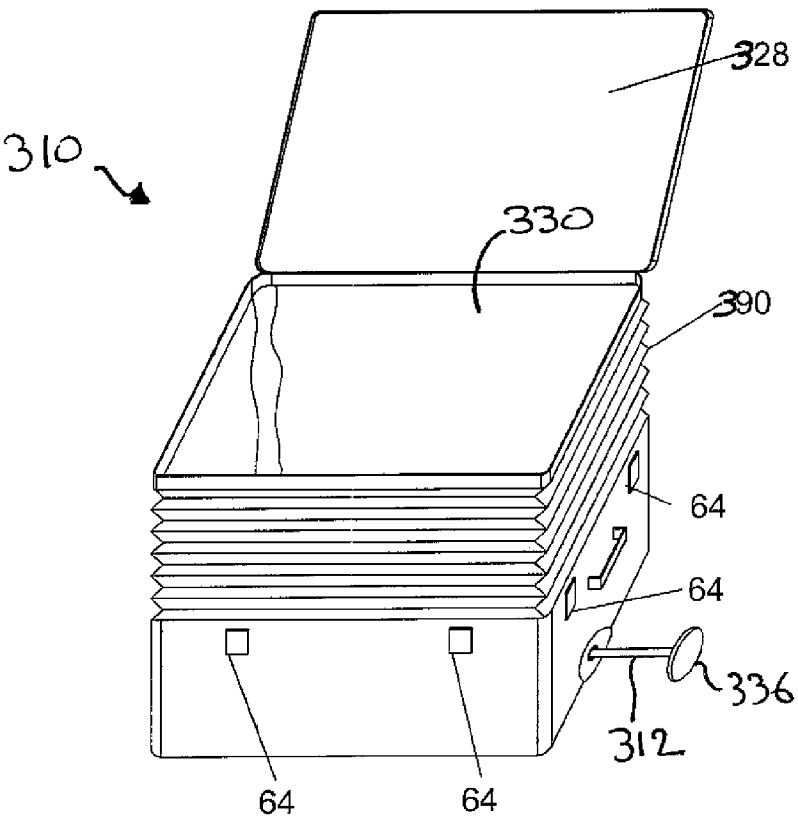

FIGS. 4A and 4B show a further embodiment of the present invention. The luggage 310 comprises a chamber 330 that is hermetically sealed when the cover 328 is closed. The chamber 330 is sealed using sealing means such as a hermetic slide fastener 358. In use, the articles are disposed in the chamber 330 of the luggage 310 and then the cover 328 is closed using the sealing means. Then, the user activates the manual pump 312 using the handle 336 to remove the air that is contained in the chamber 330. By doing so, the expandable section 390 will collapse since the volume of the chamber 330 is forced to decrease. When the expandable section 390 is completely or partially collapsed, the user fastens the latches 366 to secure the luggage.

Figure 5A:
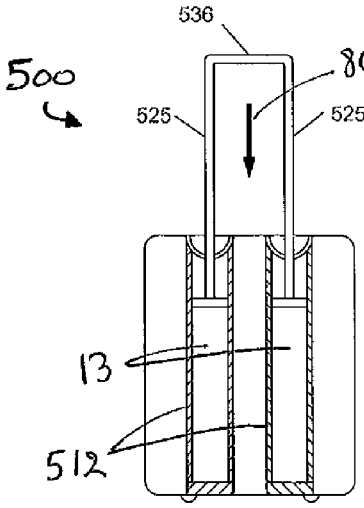
FIGS. 5A to 5G are schematic illustrations of the steps performed to vacuum the air contained in the luggage having a double handle.
Figure 5B:
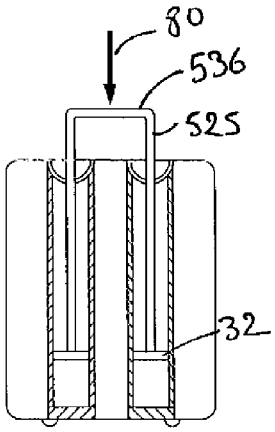
Figure 5C:
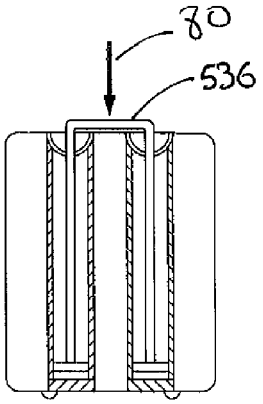
Figure 5D:
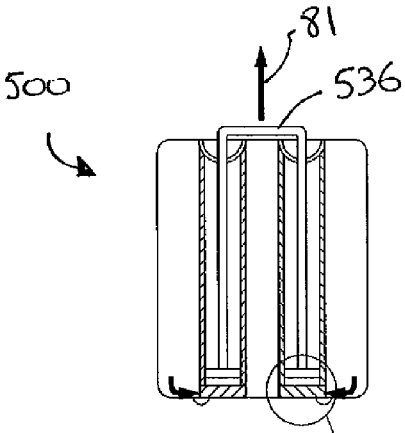
Figure 5E:
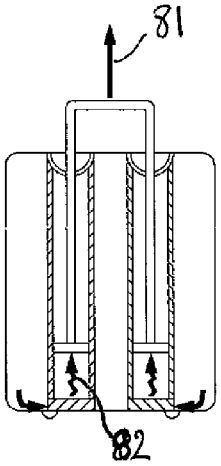
Figure 5F:
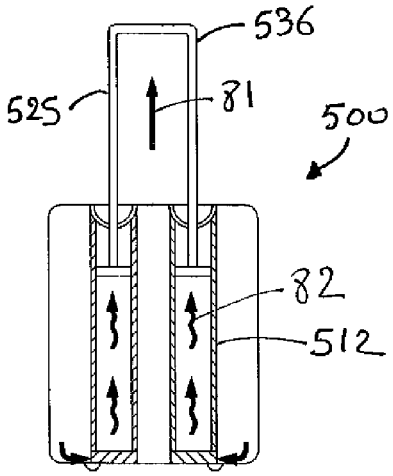
Figure 5G:
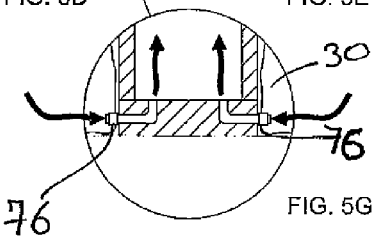

FIGS. 5A and 5B show an embodiment of the luggage 500 wherein the handle 536 is U-shaped and wherein each plunger or extremity 525 of the U-shaped handle is connected to a vacuum pump 512.

FIGS. 5A and 5B show an embodiment of the luggage wherein the handle 536 is U-shaped and wherein each plunger or extremity 525 of the U-shaped handle is connected to a vacuum pump.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A luggage with a vacuum device for storing and transporting articles, the luggage comprising:

a generally rectangular housing having four sidewalls projecting upwardly from a bottom wall to form a top opening, and a cover adapted to close the top opening;

a sealable compressible internal chamber located inside the housing, the internal chamber having an opening through which the articles are disposed and a sealing fastener to close the opening of the internal chamber, the internal chamber being airtight when the internal chamber is sealed;

two manual vacuum pumps adjacent and parallel one to the other along the bottom wall, each vacuum pump being in air communication with the internal chamber to withdraw air from the internal chamber when the internal chamber is sealed thereby reducing a volume of the internal chamber and of the articles disposed in the internal chamber, each manual vacuum pump comprising:

a longitudinal plunger having a first extremity extending outside the housing and connected to a handle for connecting each longitudinal plunger of each vacuum pump together, and a second extremity extending inside the housing and connected to a piston; and an air chamber located inside the housing along and adjacent to the bottom wall, the air chamber being adapted to slidably receive the longitudinal plunger and the piston, the piston activating the vacuum pump when moving inside the air chamber; and at least one one-way check valve connecting the internal chamber and the air chamber, the one-way check valve allowing air contained inside the internal chamber to be withdrawn from the internal chamber when the pump is activated.

2. The luggage of claim 1, wherein the plunger and the handle of the vacuum pump form a telescopic handle which, in combination with wheels operatively connected to the housing on an opposite side of the housing where the telescopic handle extends, permit ease of movement and transportability of the luggage.

3. The luggage of claim 1, wherein the sealable compressible internal chamber has a volume which is larger than a volume of the housing prior to removing air contained in the internal chamber with the pump.

4. The luggage of claim 1, wherein the sealable compressible internal chamber is formed by an airtight lining inside the housing.

5. The luggage of claim 4, wherein the housing comprises an expendable section formed by the sidewalls of the housing, the lining being attached to the sidewalls and the expendable section thereof, whereby in use, when air is withdrawn from the internal chamber by activating the pump, the expendable section of the internal chamber compresses on itself by itself.

6. The luggage of claim 4, wherein the housing comprises an expendable section formed by the sidewalls of the housing, whereby in use, when the air is withdrawn from the internal chamber, the internal chamber is reduced in size, the expendable section of the internal chamber being then compressible by a user prior to close the luggage.

7. The luggage of claim 1, wherein the housing of the luggage is airtight when the top opening is sealed with the cover, the sealable compressible internal chamber being then formed by the housing of the luggage.

8. The luggage of claim 7, wherein the walls and cover of the housing are lined with a plastic film that serves to seal the internal chamber.

9. The luggage of claim 7, wherein the housing comprises an expendable section formed by the sidewalls of the housing, whereby in use, when the air is withdrawn from the housing, the expendable section of the housing compresses on itself by itself.

10. The luggage of claim 1, further comprising at least one latch for fastening the cover to the sidewalls of the housing and securing the luggage.

11. The luggage of claim 1, the handle having a U-shape.

12. A luggage with a vacuum device for storing and transporting articles, the luggage comprising:

a general rectangular housing having four sidewalls projecting upwardly from a bottom wall to form a top opening, and a cover adapted to close the top opening;

a sealable compressible internal chamber located inside the housing, the internal chamber having an opening through which the articles are disposed and a sealing fastener to close the opening of the internal chamber, the internal chamber being airtight when the internal chamber is sealed;

two manual vacuum pumps adjacent and parallel one to the other along the bottom wall, each vacuum pump being in air communication with the internal chamber to withdraw air from the internal chamber when the internal chamber is sealed thereby reducing a volume of the internal chamber and of the articles disposed in the internal chamber, each manual vacuum pump comprising:

a longitudinal plunger having a first extremity extending outside the housing and connected to a handle for connecting each longitudinal plunger of each vacuum pump together, and a second extremity extending inside the housing and connected to a piston; and an air chamber located inside the housing along and adjacent to the bottom wall, the air chamber being adapted to slidably receive the longitudinal plunger and the piston; the piston activating the vacuum pump when moving inside the air chamber; and at least one one-way check valve connecting the internal chamber and the air chamber, the one-way check valve allowing air contained inside the internal chamber to be withdrawn from the internal chamber when the pump is activated; and wherein the plunger and the handle of the vacuum pump form a telescopic handle which, in combination with wheels operatively connected to the rectangular housing on an opposite side of the housing where the telescopic handle extends, permit ease of movement and transportability of the luggage.

* * * * *